US006212255B1

(12) United States Patent
Kirk

(10) Patent No.: US 6,212,255 B1
(45) Date of Patent: Apr. 3, 2001

(54) SYSTEM FOR X-RAY IRRADIATION OF BLOOD

(76) Inventor: Randol E. Kirk, 8208 NW. 6th St., Coral Springs, FL (US) 33071

( * ) Notice: Subject to any disclaimer, the term of this patent is extended or adjusted under 35 U.S.C. 154(b) by 0 days.

(21) Appl. No.: 09/383,226

(22) Filed: Aug. 26, 1999

Related U.S. Application Data

(60) Provisional application No. 60/098,884, filed on Sep. 2, 1998.

(51) Int. Cl.[7] ..... G21K 5/08
(52) U.S. Cl. ..... 378/66; 378/65
(58) Field of Search ..... 378/66, 65, 9, 378/10, 15; 128/214; 250/455.1

(56) References Cited

U.S. PATENT DOCUMENTS 4,321,918 * 3/1982 Clark, II ..... 128/214
4,866,282 * 9/1989 Miripol et al. ..... 250/455.1
5,459,322 * 10/1995 Warkentin ..... 250/455.11

FOREIGN PATENT DOCUMENTS

WO 99/16308 * 4/1999 (WO) .

* cited by examiner

*Primary Examiner*—David P. Porta
*Assistant Examiner*—Ivakli Kiknadre
(74) *Attorney, Agent, or Firm*—Leo J. Aubel

(57) ABSTRACT

A blood irradiator for providing a uniform dose of X-ray beam irradiation for blood contained within a transfusion bag. A first X-ray tube is positioned to irradiate said bag from one side of the bag, and a second X-ray tube is positioned to irradiate said bag from the opposite side of said bag concurrently with said first bag whereby a uniform dose of X-rays is provided to the blood.

10 Claims, 2 Drawing Sheets

SYSTEM FOR X-RAY IRRADIATION OF BLOOD

The present application claims the priority date of U.S. Provisional Patent Application Ser. No. 60/098,884 filed on Sep. 2, 1998 in the name of Randol E. Kirk, the inventor herein.

BACKGROUND OF THE INVENTION

X-Ray irradiation of blood plasma is one of the methods sanctioned by the U.S. Food and Drug Administration for providing a product which diminishes the chance of transfusion-induced diseases. For this purpose, the radiation dose and dose distributions that may occur from X-ray sources must be controlled accurately for meeting regulatory requirements. X-ray irradiation for sterilization has several advantages over gamma ray irradiation, electron beam application and other types of blood purification. First, X-rays can be accurately controlled in application and secondly, equipment for providing the X-rays is relatively safe, and also, the equipment for providing the X-rays is comparatively inexpensive as compared to the other types of blood purification.

SUMMARY OF INVENTION

The inventive blood irradiator provides a uniform dose of X-ray beam irradiation for a blood plasma contained in a blood transfusion bag. In one embodiment, the bag is placed in a selected cannister for receiving the X-ray beam, and the system includes two X-ray tubes positioned to irradiate the bag from opposite sides to provide a uniform radiation to the blood in the bag.

The foregoing features and advantages of the present invention will be apparent from the following more particular description of the invention. The accompanying drawings, listed herein below, are useful in explaining the invention.

DESCRIPTION OF THE INVENTION

The present invention provides an apparatus for insuring dose uniformity for a blood contained in a transfusion bag that receives X-ray beam radiation from X-ray tubes.

Figure 1:
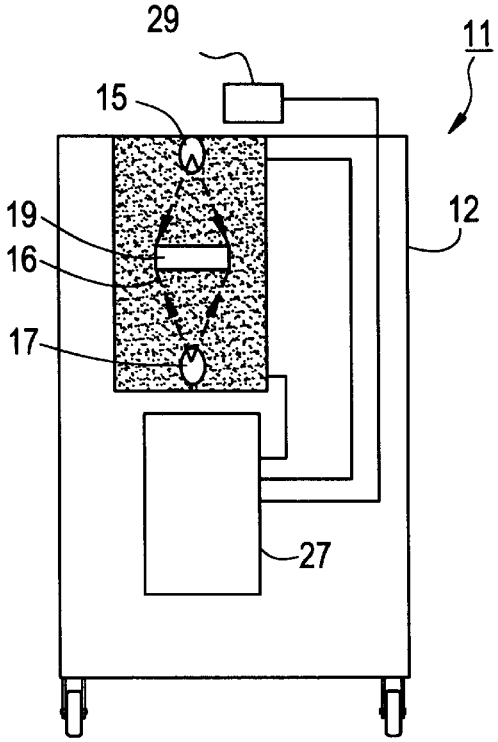
FIG. 1 is a view showing a schematic of a basic structure of the inventive system.
Figure 2:
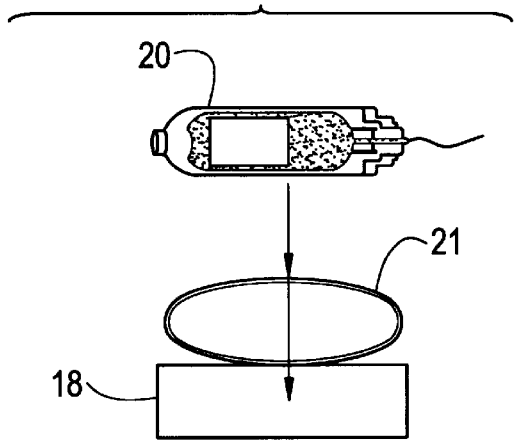
FIG. 2 is a view showing a blood transfusion bag and the cannister for receiving the bag.
Figure 3:
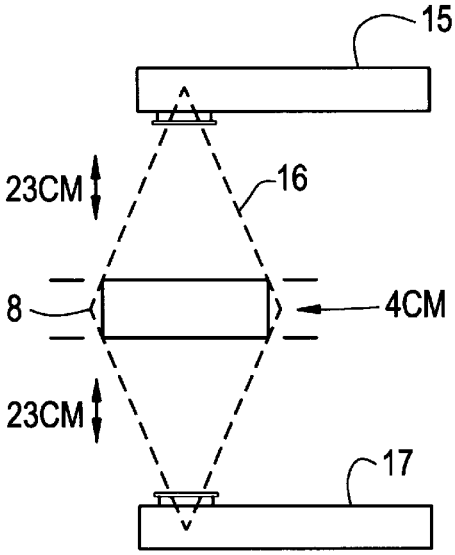
FIG. 3 is a sketch showing the positioning of the X-ray tubes relative to the cannister of one embodiment of the invention and is useful in explaining the apparatus for irradiating the bags.

Referring to FIGS. 1–3, the inventive X-ray system 11 comprises a suitably shielded apparatus or machine 12, which may be portable. The machine 12 includes a first X-ray tube or source 15 which is oriented to provide a beam of X-rays downwardly, indicated by the dotted lines 16, to a chamber 19 which is adapted to receive a cannister or container 18 for the blood plasma bag.

The cannister 18 has an oval shaped interior for receiving the transfusion bag 20, and includes a cover or top 21, see FIG. 2. The cannister 18 is dimensioned and positioned to maintain the blood plasma transfusion bag 20 at a precise distance and position relative to the X-ray tube 15, see FIG. 3. Cover 21 controls the depth or thickness of the blood bag 20 within cannister18. Importantly, the cannister 18 is dimensioned to receive the cover 21 to maintain the thickness of 4 cm throughout the bag. The system includes suitable radiation security switches so that X-ray exposures can be initiated only when all the radiation doors have been closed, as is known.

In the embodiment shown, X-ray tube 15 has an output of 160 kV and the X-ray beam output port of tube 15 is designed to provide a relatively wide X-ray beam of 40–50 degrees in order to provide a beam with a sufficiently large diameter to fully cover the cannister 18 and the included bag 20, as will be discussed. The X-ray tube is positioned relatively close, that is 23 cm, from the upper surface of cannister 18 to assure that maximum energy is delivered to the bag 20. As is known, the closer an X-ray source is to object to be irradiated, the higher the energy delivered to the object; that is, the level of the energy delivered to the object is dependent on the distance between the two components. As is also known, the object can be irradiated faster when more energy is delivered to the object.

It is of particular importance that the irradiation received by the blood plasma in bag 20 be uniform. That is, the blood in the bag must be uniformly irradiated; that is, irradiation energy within a specified range must be provided to the blood for the same period of time to meet Federal regulations. For this purpose of providing an efficient uniform irradiation of the blood plasma bag, in the embodiment of FIGS. 1–3, a second X-ray tube 17 is provided on the opposite side of the cannister 18. The X-ray tube 17 is essentially identical to X-ray tube 15 and provides energy to the opposite surface or side of the bag 20. Tube 17 is positioned the same distance from the cannister as is tube 15, that is at 23 cm from the lower surface of cannister 18. Hence, the transfusion bag 20 is concurrently irradiated from two separate X-ray sources for a precise time.

In the embodiment of FIG. 1, the two X-ray tubes 15 and 17 are powered by the same power supply from an AC source connected through adapter 29. Two separate power sources may be provided.

It is clear from FIG. 2, that the irradiation energy from X-ray tube 17 complements the irradiation energy from X-ray tube 15. Since the energy level varies as the beam penetrates the 4 cm thick bag of blood; the energy provided changes with the depth or thickness of the blood in bag 20. (As stated above, the thickness of the bags is a maintained at 4 cm by the cannister.) The energy from tube 15 is maximum at the top surface of blood bag 20 and decreases as it penetrates the bag 20, and is effectively at a minimum level at the lower surface of bag 20. Conversely, the radiation energy from X-ray tube 17 is maximum at the lower surface of bag 20 and decreases to a minimum at the top surface of bag 20. The relation of the irradiation energy at any level or depth of bag 20 is a sum of the energy developed by the two tubes. In practice it has been found that irradiation of a blood plasma bag for about six minutes with the apparatus disclosed complies with Federal regulations.

The blood in bag 20 becomes a factor in controlling the dose distribution for the irradiation. The kV, mA, time and filtration of the beam are carefully controlled to assure that the applicable dose delivered to all parts of the bag is similar. Transfusion bags vary in both size and configuration and the cannister 20 accommodates the different varieties while maintaining a maximum thickness of 4 cm or less. As is known, X-ray energy is absorbed in a particular item as a function of density of the material and depth to be penetrated.

In the particular embodiment of FIG. 1, the energy level of the X-ray tubes is 160 kV. It has been found that to maintain uniformity of radiation to all parts of the bag, the tubes must provide each at least 150 kV output to comply with the FDA specifications that the irradiation be within a range of 1500–2500 rads. The X-ray tubes 15 each irradiate the bag 20 with a surface dose of 2500 rads and an exit dose of 1500 rads. Present requirements are that the bag be irradiated for a six minutes. Ideally, the irradiation dose effective at the center of the blood plasma in bag 20 is the same as the dose at the blood plasma adjacent the opposite (upper and lower) surfaces of the bag.

Further, it has been found that the output port of each of the X-ray tubes 15 and 17 should preferably have a diameter to provide a 45 degree beam such that the beam has at least a diameter of 15.5 cm at 23 cm distant from the tube. This permits the tubes to be placed closer to the bag, since as is known, the effective radiation is dependent on the distance of the object from the source.

It has also been found important to provide an efficient ion pump to maintain a good vacuum in the X-ray tube. An ion pump is preferred since the tube is used frequently for short periods, and hence any impurities in the vacuum can not be purged merely by usage and heating of the tube. Thus an efficient ion pump is used. In the embodiment shown the tubes both have a rating of 160 kV; however, theoretically the tubes could have different outputs rating. The 160 kV tubes are commercially available tubes with known characteristics and are manufactured by various reliable sources.

The bags 20 used in blood transfusion bags vary in both size and configuration. The cannister 18 accommodates the different varieties of bags while maintaining the bag at a maximum thickness of 4 cm or less. This insures the dose delivered to any part of the blood will be no more than 2500 rads and no less than 1500 rads, all per FDA specifications. The size of the chamber is related to the minimum width of the variety of blood bags to be accommodated. As depicted in FIG. 2, in one embodiment the dimensions of cannister are 15.5 cm×12 cm×4 cm, and cannister contains the bag 20 in a snug tight position. An important concept in this application is that the transfusion bag 20 is held at a maximum thickness of 4 cm throughout.

As mentioned above, X-ray energy is absorbed in a particular material as a function of density and depth to be penetrated. As alluded to above it is important in system 11 that the distance from the X-ray source 15 to the upper surface of bag 20 is 23 cm, and the distance to the lower surface of the bag 20 is 27 cm. The configuration is symmetrical; that is, the distance from the X-ray source 17 to the lower surface of the bag 20 is 23 cm, and the distance to the upper surface of the bag 20 is 27 cm.

Figure 5:
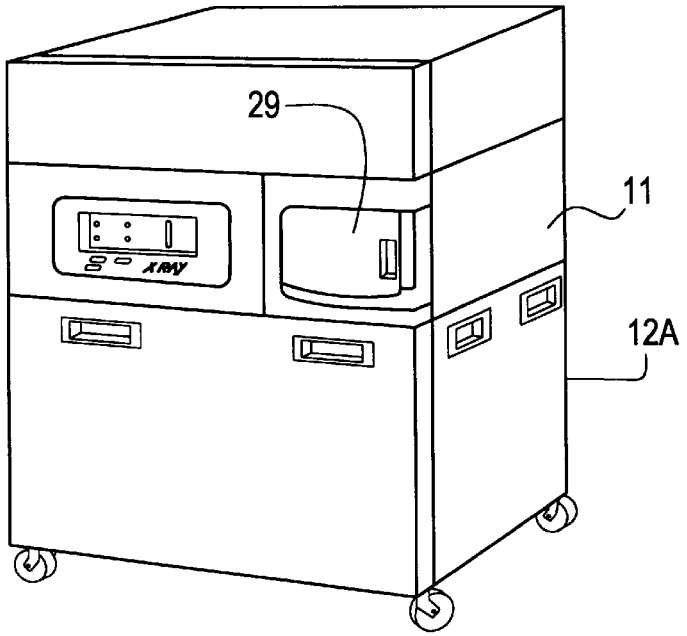
FIG. 5 is an embodiment of the invention wherein the machine 12 includes a sliding door for closing the irradiation chamber.
Figure 6:
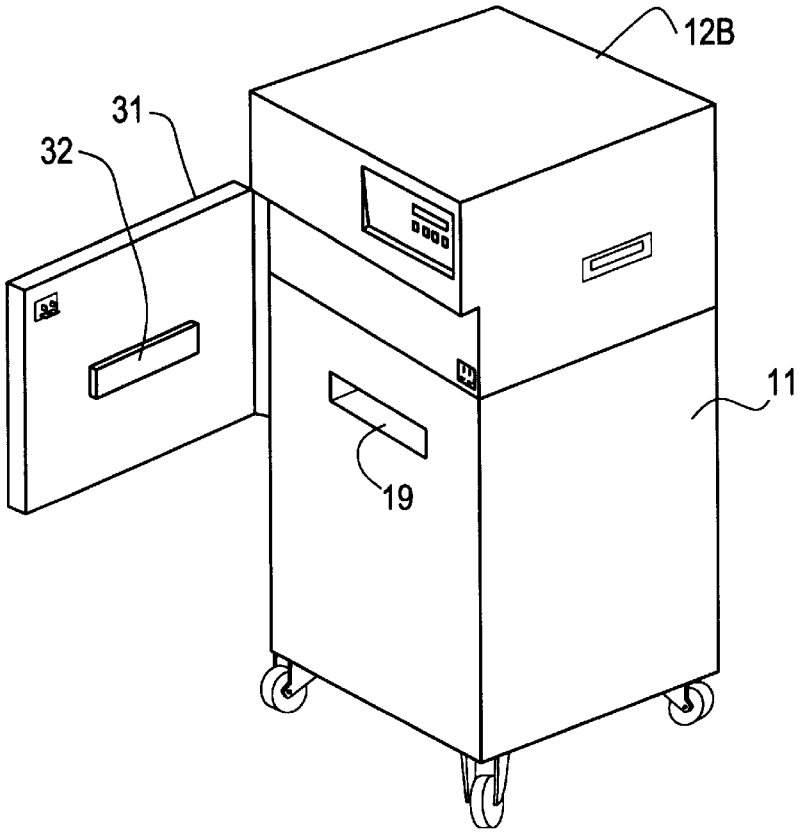
FIG. 6 shows an embodiment of the invention having hinged door for closing the irradiation chamber.

FIG. 5 shows an embodiment of the inventive system 11 wherein the machine 12A includes a door 29 mounted on a pivot to slidably close the irradiation chamber 19. FIG. 6 shows an embodiment of the invention wherein the machine 12 includes a hinged door 31 with a plug 32 for closing the irradiation chamber 19.

Figure 4:
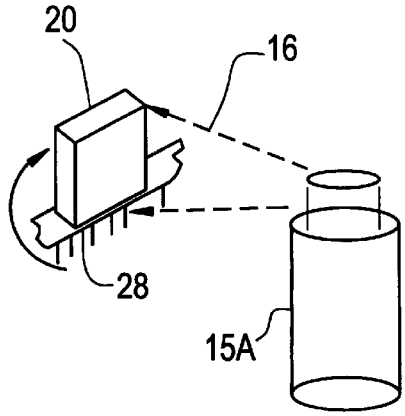
FIG. 4 is a sketch of an embodiment of the invention using a single source of irradiation.

FIG. 4 depicts a second embodiment of the invention wherein a blood plasma bag 20 is positioned to be irradiated by a single X-ray tube 15A. In this embodiment, the plasma bag 20 is mounted in a vertical orientation, that is its longest length is vertical and its 4 cm thickness is positioned vertically as contrasted to the horizontal orientation of the bag 20 shown in FIGS. 1–3. A first surface or side of the plasma bag 20 is irradiated for a preselected time period. Next, rotatable support 28 rotates the bag about its vertical axis, and the opposite surface of the bag 20 irradiated for an equal period of time. The cumulative irradiation provided to the opposite surfaces or sides is thus effective to provide a uniform irradiation to the blood contained in the bag.

While the invention has been particularly shown and described with reference to a particular embodiment thereof it will be understood by those skilled in the art that various changes in form and detail may be made therein without departing from the spirit and scope of the invention.

What is claimed is:

1. An X-ray irradiator for providing a uniform dose of X-ray beam irradiation to blood in a transfusion bag, said irradiator comprising in combination, a) a chamber for mounting said transfusion bag;

b) X-ray tubes mounted on opposed sides of said chamber; said tubes providing X-ray beams of radiation to said bag from opposite sides of said bag; and c) said tubes each providing radiation at a same selected energy level to said bag to thereby provide a total radiation energy to said bag which is substantially uniform throughout said bag.

2. An X-ray irradiator as in claim 1 wherein said tubes each provide a beam of radiation to fully cover the area of said transfusion bag transverse to said beams.

3. An X-ray irradiator as in claim 1 further including a) a cannister for confining said bag to have a uniform maximum thickness measured transverse to the beam radiation from said tubes.

4. An irradiator as in claim 3 wherein the cannister maintains the maximum thickness of said bag at 4 cm.

5. An irradiator as in claim 1 wherein said X-ray tubes each provide radiation at 160 kV, and are positioned 23 cm from said bag to irradiate said bag with a surface dose of 2500 rads and an exit dose of 1500 rads.

6. An X-ray irradiator for providing a uniform dose of X-ray beam irradiation to a transfusion bag blood, said bag being in the form of a rectangular box-like container, said irradiator comprising in combination, a) source of X-ray radiation providing a beam of X-ray to cover a defined vertical area; and, b) means for positioning said bag with its thickness dimension perpendicular to said beam to permit said beam to irradiate a first surface of said bag;

c) a support for said bag; and d) means for rotating said support to cause said beam to irradiate the surface of said bag opposite said first surface.

7. An X-ray irradiator for providing a uniform dose of X-ray beam irradiation to blood in a transfusion bag which bag is pliable and is contained in a cannister said irradiator comprising in combination, a) a chamber for receiving said cannister containing mounting said transfusion bag;

b) first has X-ray tubes mounted to provide irradiation to opposite surfaces of said bag;

c) the irradiation of said tubes effectively combining to provide uniform irradiation to the blood in said bag.

8. An X-ray irradiator as in claim 7 wherein said tubes each provide a beam of radiation to fully cover the area of said cannister transverse to said beams.

9. An X-ray irradiator as in claim 1 further including n ion pump to provide a vacuum in said X-ray tubes.

10. An X-ray irradiator as in claim 1 wherein a) the same power supply supplies power to both tubes.

* * * * *